US009084503B2

(12) United States Patent
Olivas

(10) Patent No.: US 9,084,503 B2
(45) Date of Patent: Jul. 21, 2015

(54) AIR CONDITIONER CURTAIN

(71) Applicant: Matilde Olivas, Amarillo, TX (US)

(72) Inventor: Matilde Olivas, Amarillo, TX (US)

( * ) Notice: Subject to any disclaimer, the term of this patent is extended or adjusted under 35 U.S.C. 154(b) by 0 days.

(21) Appl. No.: 14/023,795

(22) Filed: Sep. 11, 2013

(65) Prior Publication Data

US 2014/0076506 A1 Mar. 20, 2014

Related U.S. Application Data

(60) Provisional application No. 61/701,255, filed on Sep. 14, 2012.

(51) Int. Cl.

| | |
|---|---|
| ***E06B 7/28*** | (2006.01) |
| ***A47H 23/04*** | (2006.01) |
| ***A47H 99/00*** | (2009.01) |

(52) U.S. Cl.

CPC ..... *A47H 23/04* (2013.01); *A47H 99/00* (2013.01)

(58) Field of Classification Search

CPC ..... E06B 7/32; E06B 7/02
USPC ..... 160/180, 368.1, 127, 330; 454/203, 454/201, 200.196, 211, 276
See application file for complete search history.

(56) References Cited

U.S. PATENT DOCUMENTS

| | | | | |
|---|---|---|---|---|
| 2,414,592 | A * | 1/1947 | Garlinski | 160/91 |
| 2,487,294 | A * | 11/1949 | Belter | 454/210 |
| 3,251,399 | A * | 5/1966 | Grossman | 160/180 |
| 4,371,026 | A * | 2/1983 | Miller et al. | 160/349.2 |
| 4,759,194 | A | 7/1988 | Shapiro | |
| 5,125,197 | A | 6/1992 | Fuchs | |
| 5,195,869 | A * | 3/1993 | Groenhoff | 415/213.1 |
| 6,865,850 | B1 * | 3/2005 | Campbell | 52/202 |
| 8,365,804 | B1 * | 2/2013 | Genovese et al. | 160/351 |
| 2006/0218957 | A1 | 10/2006 | Nakamura | |
| 2007/0181271 | A1 * | 8/2007 | Earnest | 160/368.1 |
| 2008/0108294 | A1 | 5/2008 | Reed | |
| 2010/0307179 | A1 | 12/2010 | Fava | |
| 2012/0289145 | A1 * | 11/2012 | Kerlinger, Jr. | 454/358 |
| 2014/0076506 | A1 * | 3/2014 | Olivas | 160/237 |

* cited by examiner

*Primary Examiner* — Blair M Johnson

(74) *Attorney, Agent, or Firm* — Buckingham, Doolittle & Burroughs, LLC

(57) ABSTRACT

An air conditioning curtain device is disclosed that allows users to hang curtains or drapes over windows with air conditioning units without blocking the air conditioning units. The air conditioning curtain device comprises a piece of material with a continuous opening therein. Typically, the material is secured around a perimeter of an air conditioner output vent via elastic. Further, the air conditioning curtain device can comprise a flap component attached to an edge of the continuous opening for covering the continuous opening and the air conditioner unit. The flap component can be removably or fixedly attached to the edge of the continuous opening depending on the wants and needs of a user. The flap component is typically constructed of the same material as the piece of material, and can vary in size.

17 Claims, 5 Drawing Sheets

AIR CONDITIONER CURTAIN

CROSS-REFERENCE

This application claims priority from Provisional Patent Application Ser. No. 61/701,255 filed Sep. 14, 2012.

BACKGROUND

Many people use window air-conditioning units to keep their home or apartment cool when it's hot outside. When using these types of air conditions, however, people have to either remove their curtains or constantly have them open, as to not block the front of the unit and/or the conditioned air emanating therefrom. Without any type of curtain on the window, the room may lack a sense of style and/or privacy. Additionally, without curtains blocking sun from shining in, the air-conditioner may have to work harder to cool the room. This can increase a person's utility bill and is inefficient. An effective solution is necessary.

The present invention provides users with a way to hang curtains or drapes around windows with air-conditioning units or window fans. Also, the air conditioning curtain device resembles a curtain or drape with a hole in the middle, revealing the face of the air-conditioning unit. Additionally, by using this device, users increase privacy and add style to the décor, as well as prevent sunlight from shining into the room and raising the temperature while the air conditioning unit is running. Moreover, this device is ideal for homeowners, renters, and possibly small-business owners who have air-conditioning units or window fans in their windows.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an air conditioning curtain device that allows users to hang curtains or drapes over windows with air conditioning units without blocking the air conditioning units. The air conditioning curtain device comprises at least one piece of material with at least one continuous opening therein for receipt of a window air conditioning unit. More specifically, the at least one piece of material is secured around a perimeter of the window air conditioner output vent. Any number of openings can be positioned on the piece of material as needed by the user, depending on the number and size of the air conditioning units being used. Further, the openings can be positioned on any suitable position on the piece of material, depending on the wants and needs of a user. Typically, the openings can be any suitable shape, such as a slit or a rounded, through-hole.

In a preferred embodiment, the opening is secured around a perimeter of an air conditioner output vent via elastic or any other suitable elastomeric material. Further, the air conditioning curtain device can comprise a flap component attached to an edge of the opening for covering the opening. The flap component can be removably or fixedly attached to the edge of the opening depending on the wants and needs of a user. The flap component is typically constructed of the same material as the piece of material, and can vary in size depending on the wants and needs of a user, as well as the size and shape of the air conditioning unit the flap component is covering.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
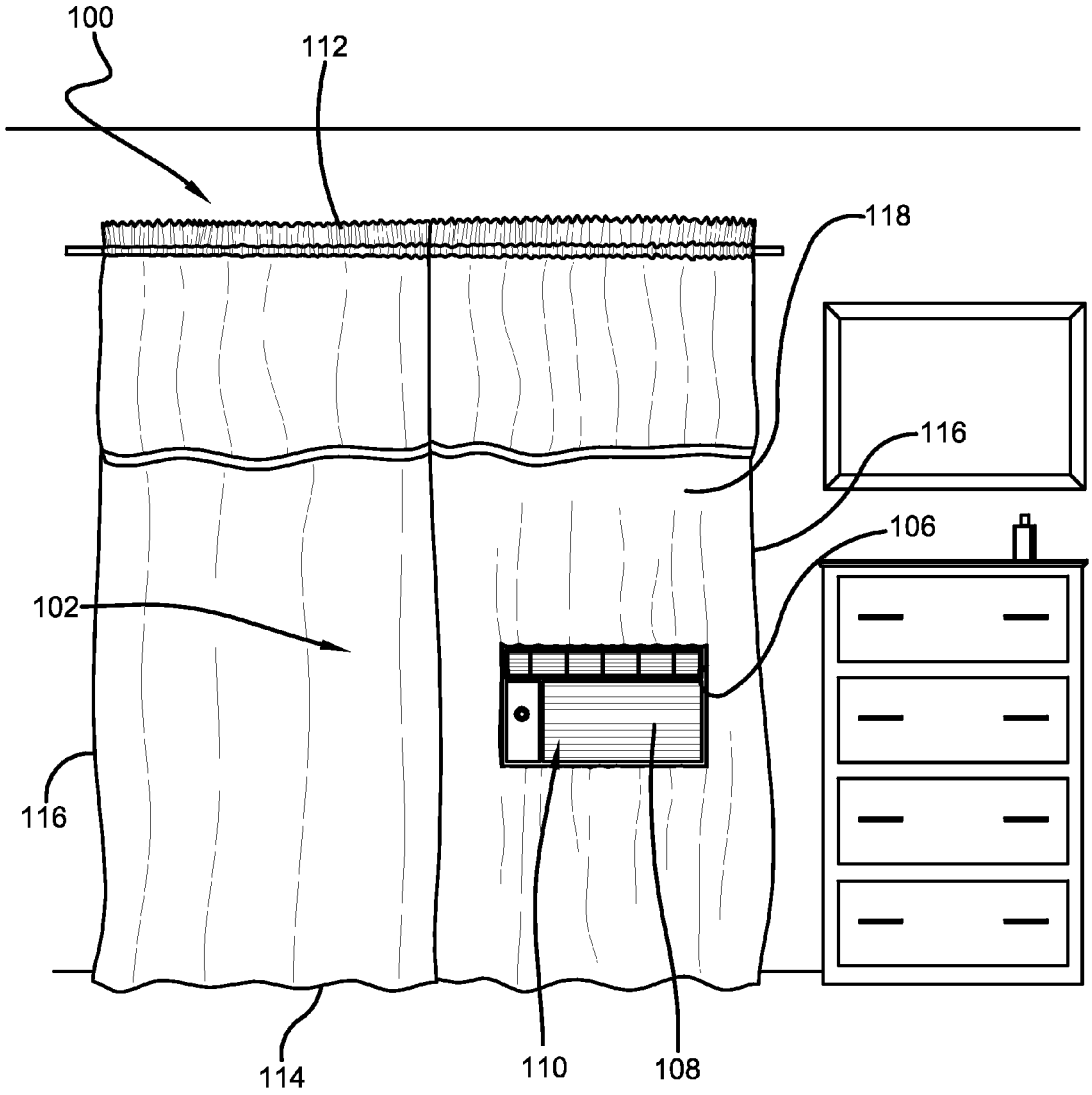
FIG. 1 illustrates a perspective view of the air conditioning curtain device secured around an air-conditioning unit in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention provides users with a way to hang curtains or drapes around window air-conditioning units or window fans. Further, the air conditioning curtain device resembles a curtain or drape with a continuous opening therein to accommodate the face of the air-conditioning unit. Additionally, by using this device, users may increase privacy and add style to their décor, as well as prevent sunlight from shining into the room and raising the temperature while the air conditioning unit is running. Moreover, this device is ideal for homeowners, renters, and possibly small-business owners who have air-conditioning units or window fans in their windows.

The disclosed air conditioning curtain device comprises a piece of material with a continuous opening therein for receipt of a window air conditioning unit or window fan. Typically, the opening is secured around a perimeter of an air conditioner output vent or window fan via elastic. Further, the air conditioning curtain device can comprise a flap component attached to an edge of the opening for covering the opening and the air conditioner unit when the same is not in use. The flap component can be removably or fixedly attached to the edge of the opening depending on the wants and needs of a user. The flap component is typically constructed of the same material as the piece of material, and can vary in size.

Figure 2:
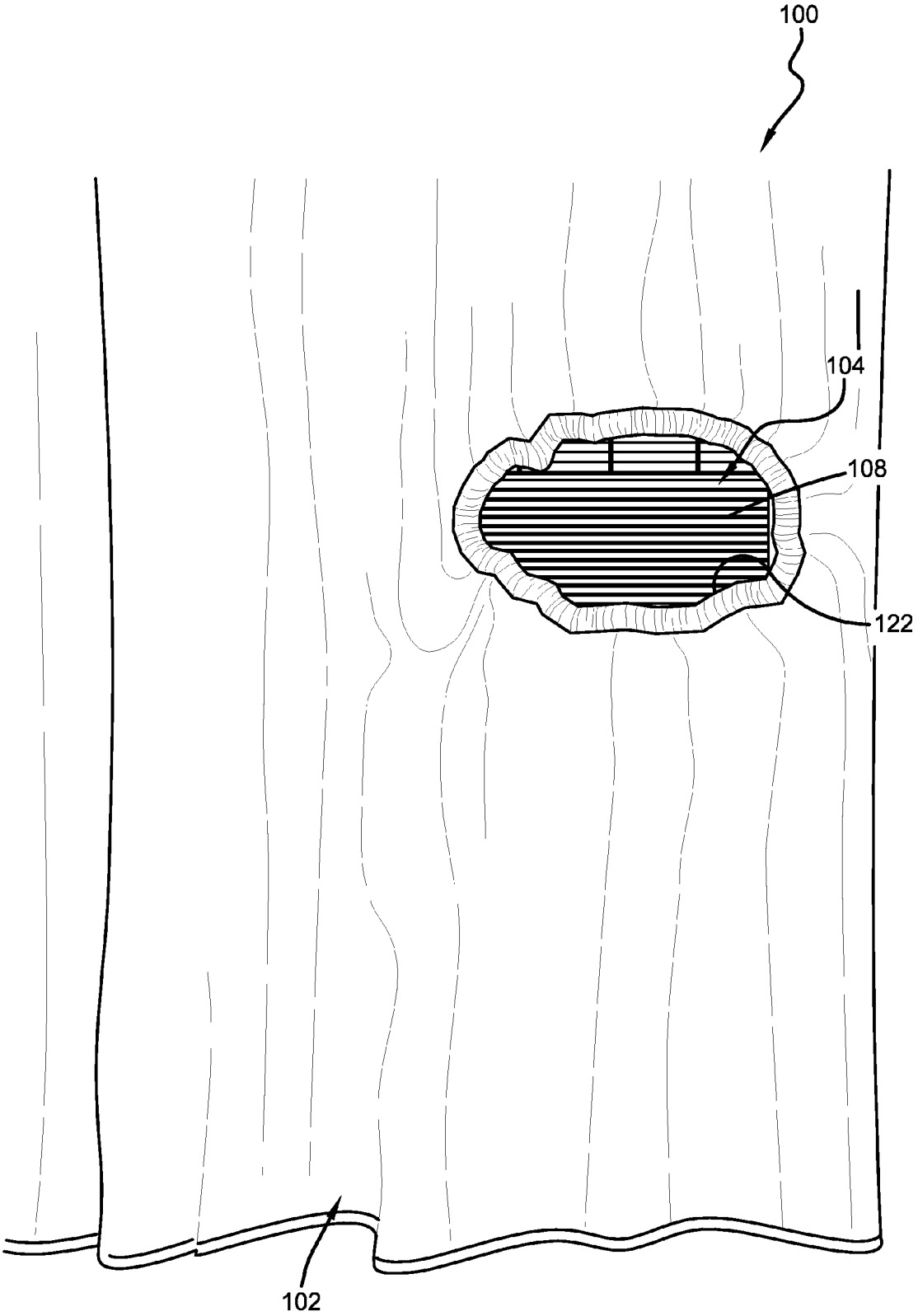
FIG. 2 illustrates a perspective view of the air conditioning curtain device in accordance with the disclosed architecture.
Figure 3:
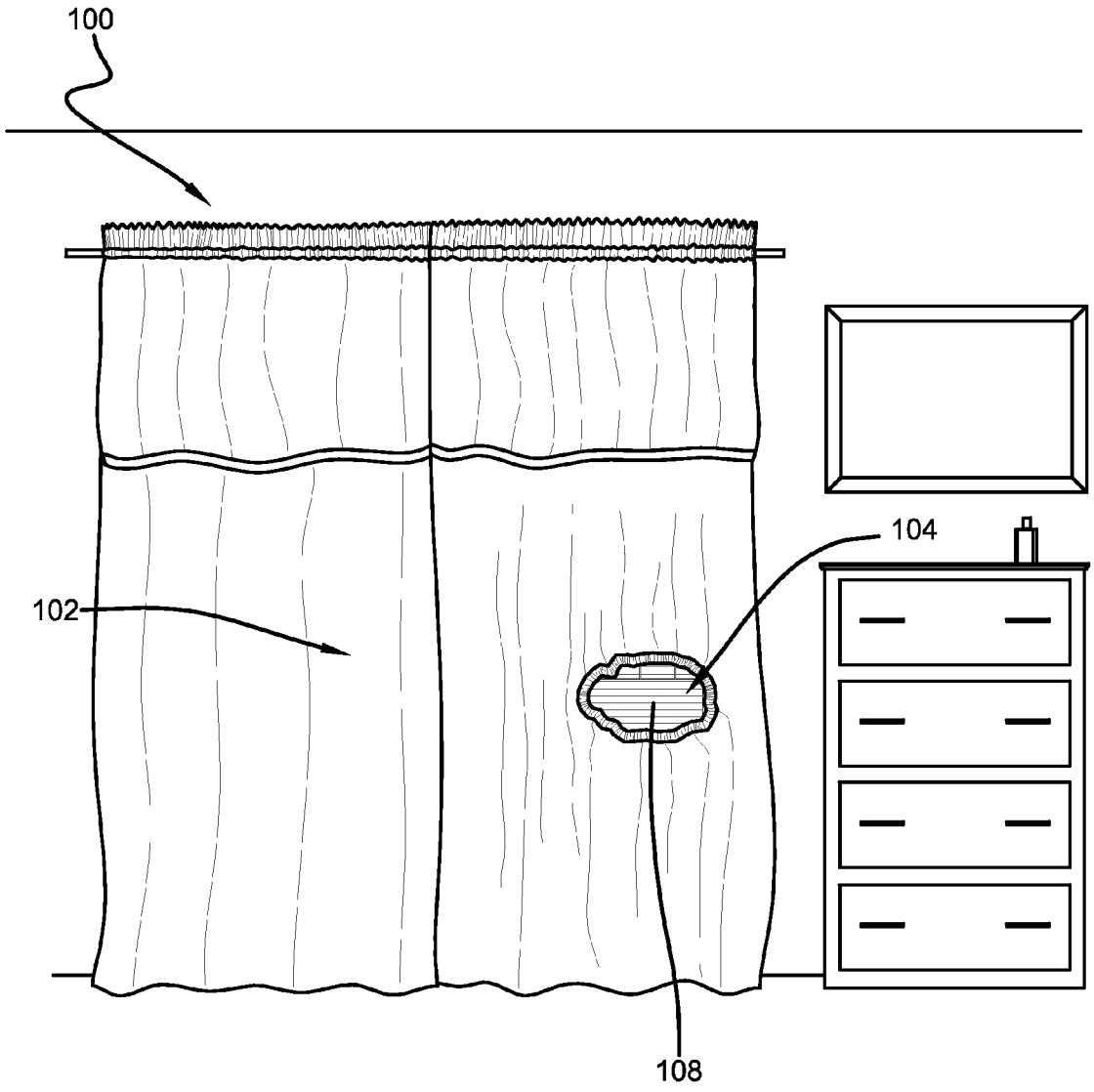
FIG. 3 illustrates a perspective view of the air conditioning curtain device in accordance with the disclosed architecture.

Referring initially to the drawings, FIGS. 1-3 illustrate the air conditioning curtain device 100 that allows users to hang curtains or drapes over windows with air conditioning units 110 without blocking the air conditioning units 110. The air conditioning curtain device 100 comprises at least one piece of material 102 with at least one continuous opening 104 positioned on the at least one piece of material 102, wherein the at least one piece of material 102 is secured around a perimeter 106 of an air conditioner output vent 108 (as shown in FIG. 1).

The piece of material 102 comprises a first end portion 112, a second end portion 114, and opposing sides 116. Typically, the piece of material 102 can be any suitable shape as is known in the art without affecting the overall concept of the invention, such as rectangular, square, oval, circular, etc., and the edges can be scalloped, pointed, curved, etc. The piece of material 102 would generally be constructed of cotton, silk, rayon, denim, suede, leather, fur, embroidered/crewel, matelasse, sheers, lace, tapestries, velvet, upholsteries, polyesters, chenille, linen, satin, base cloth, vinyl, felt, nylon, tulle, flax, etc., or any other suitable textile material may be used to manufacture the piece of material 102 as is known in the art without affecting the overall concept of the invention.

The piece of material 102 can also comprise a variety of colors and designs to suit user and manufacturing preference. While the shape and size of the piece of material 102 may vary greatly depending on the wants and needs of a user, as well as the size and shape of the window the material 102 is covering, the piece of material 102 can be approximately between 10 and 40 inches long as measured from the first end portion 112 to the second end portion 114, and approximately between 10 and 40 inches wide as measured from opposing sides 116, and approximately between 12 and 36 inches thick as measured from a front surface 118 to a back surface (not shown). Further, any number of pieces of material 102 can be used as needed by the user, depending on the amount and size of the windows needing to be covered.

The air conditioning curtain device 100 further comprises at least one continuous opening 104 therein (as shown in FIG. 2). Any number of continuous openings 104 can be positioned on the piece of material 102 as needed by the user, depending on the number and size of the air conditioning units 110 being used, as well as the number of windows being used. Further, the openings 104 can be positioned on any suitable position on the piece of material 102, depending on the wants and needs of a user and the particular location of the air conditioning unit.

Typically, the continuous opening 104 can be any suitable shape as is known in the art without affecting the overall concept of the invention, such as rectangular, square, oval, circular, a slit, or a rounded, through-hole, etc. Further, the shape and size of the opening 104 may vary greatly depending on the wants and needs of a user, as well as depending on the size and shape of the air conditioning unit 110 the material 102 is being secured around.

Furthermore, the material 102 is secured around a perimeter 106 of an air conditioner output vent 108. Typically, the material 102 is secured around the perimeter 106 via elastic or any other suitable elastomeric material as is known in the art without affecting the overall concept of the invention, such as nylon, Lycra®, etc. (as shown in FIG. 3). The elastic or other elastomeric material allows the opening 104 to be stretched around the perimeter 106 of the air conditioner output vent 108, securing the opening 104 around the air conditioner unit 110. Typically, the elastic or other elastomeric material is sewn into the perimeter of the opening 104, or can be secured via any other suitable securing means as is known in the art.

Additionally, the air conditioning curtain device 100 further comprises a flap component 120 attached to an edge 122 of the opening 104 for covering the opening 104, for example, when the air conditioning unit is not in use and the user desires to conceal the same. The flap component 120 can be removably or fixedly attached to the edge 122 of the opening 104 depending on the wants and needs of a user.

If the flap component 120 is fixedly or permanently attached to the edge 122 of the opening 104, the flap component 120 would be sewn on or secured via any other suitable securing means, such as gluing, etc. The flap component 120 could then be held in an open position via hook and loop fasteners (i.e., Velcro®), or any other suitable securing means as is known in the art.

If the flap component 120 is removably attached to the edge 122 of the opening 104, the flap component 120 would be secured via hook and loop fasteners (i.e., Velcro®), or secured via any other suitable securing means, such as snaps, etc. The flap component 120 could then be held in an open position via the hook and loop fasteners (i.e., Velcro®), or just removed during use and stored elsewhere.

The flap component 120 is typically constructed of the same material as the piece of material 102. For example, the flap component 120 would generally be constructed of cotton, silk, rayon, etc., or any other suitable textile material as is known in the art without affecting the overall concept of the invention. The flap component 120 can also comprise a variety of colors and designs to suit user and manufacturing preference. Further, the shape and size of the flap component 120 can vary greatly depending on the wants and needs of a user, as well as the size and shape of the air conditioning unit 110 the flap component 120 is covering.

The air conditioning unit 110 used with the air conditioning curtain device 100 is typically a window unit air conditioner, but any other air conditioning unit or window fan can be used as is known in the art, such as a stand-alone indoor unit, etc.

Figure 4:
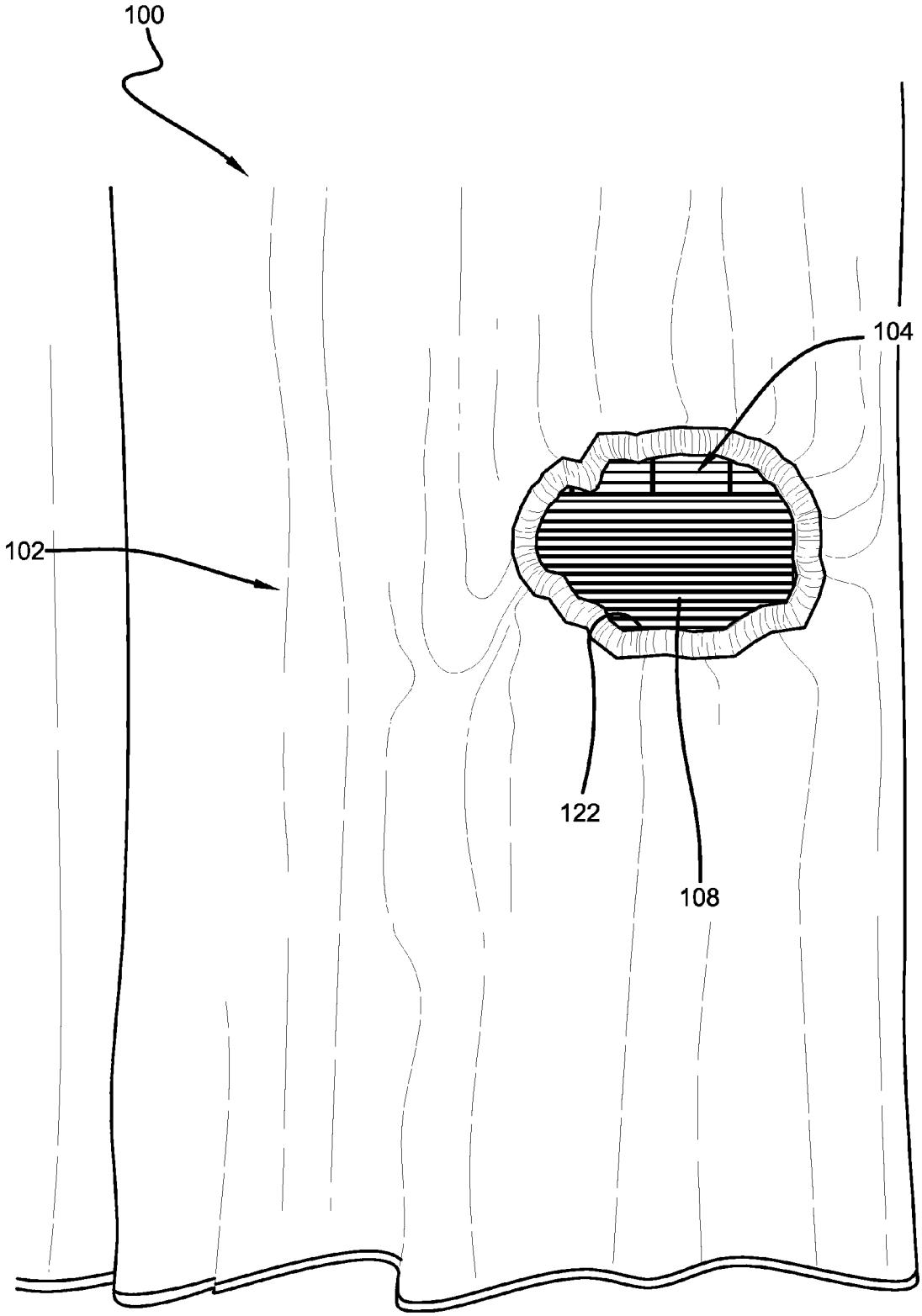
FIG. 4 illustrates a perspective view of the air conditioning curtain device in use in accordance with the disclosed architecture.

FIG. 4 illustrates the air conditioning curtain device 100 in use. In operation, a user (not shown) would choose the size, shape, and/or design of the air conditioning curtain device 100 that meets their needs and/or wants. Specifically, the user would determine the size, shape, and/or design of the material 102 that meets their needs and/or wants, depending on the number and size of the windows that need to be covered and the size and positioning of the air conditioning unit. The user would then position the opening 104 in the material 102, such that it is secured around a perimeter 106 of an air conditioner output vent 108.

Once in place, the user can attach the flap component 120 to cover the face of the air conditioning unit 110 when the air conditioning unit 110 is not in use or the user wished to conceal the same. Thus, by using this device 100, users may increase privacy and add style to their décor, as well as prevent sunlight from shining into the room and raising the temperature while the air conditioning unit 110 is running.

Figure 5:
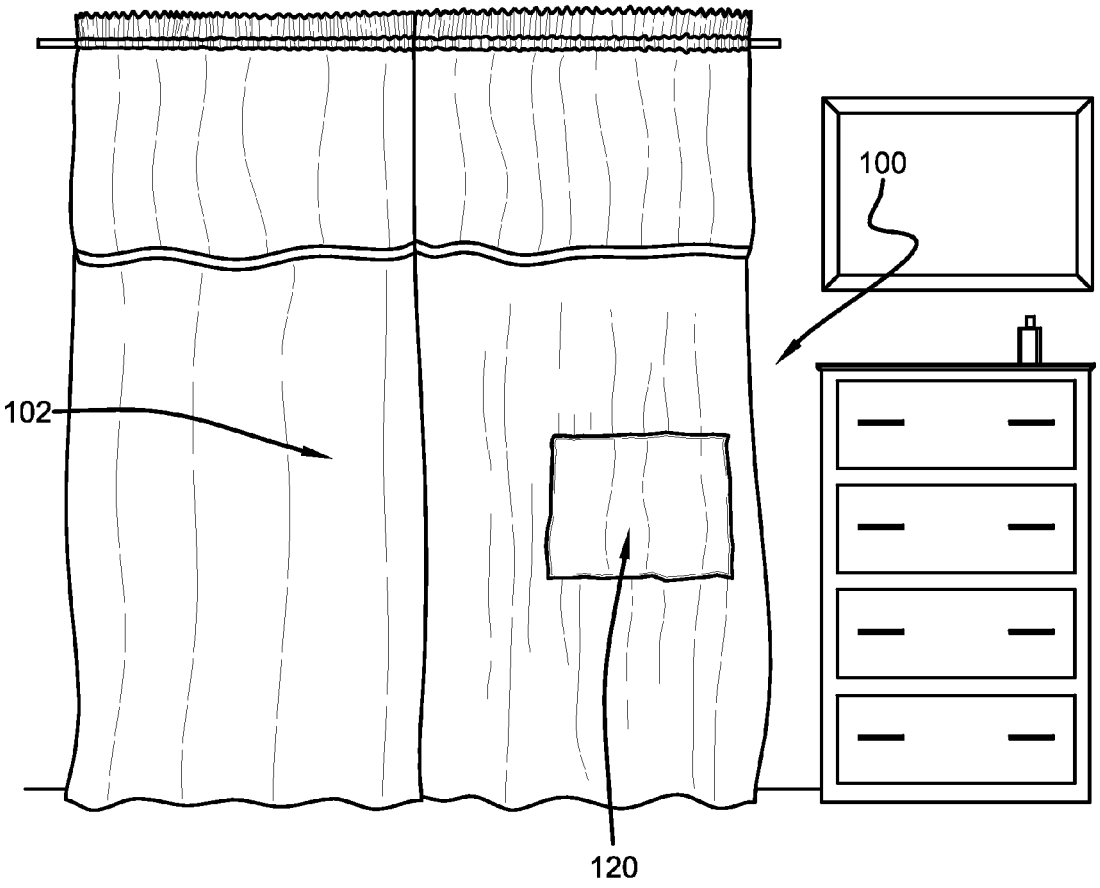
FIG. 5 illustrates a perspective view of the air conditioning curtain device with the flap component covering the air conditioning unit in accordance with the disclosed architecture.

FIG. 5 illustrates the air conditioning curtain device 100 with the flap component 120 covering the air conditioning unit 110. As stated supra, the air conditioning curtain device 100 can comprise a flap component 120 attached to an edge 122 of the opening 104 for covering the opening 104. The flap component 120 can be removably or fixedly attached to the edge 122 of the opening 104 depending on the wants and needs of a user.

If the flap component 120 is fixedly or permanently attached to the edge 122 of the opening 104, the flap component 120 would be sewn on or secured via any other suitable securing means, such as gluing, etc. The flap component 120 could then be held in an open position via hook and loop fasteners (i.e., Velcro®), or any other suitable securing means as is known in the art.

If the flap component 120 is removably attached to the edge 122 of the opening 104, the flap component 120 would be secured via hook and loop fasteners (i.e., Velcro®), or secured via any other suitable securing means, such as snaps, etc. The flap component 120 could then be held in an open position via the hook and loop fasteners (i.e., Velcro®), or just removed during use and stored elsewhere.

The flap component 120 is typically constructed of the same material as the piece of material 102. For example, the flap component 120 would generally be constructed of cotton, silk, rayon, etc., or any other suitable textile material as is known in the art without affecting the overall concept of the invention. The flap component 120 can also comprise a variety of colors and designs to suit user and manufacturing preference. Further, the shape and size of the flap component 120 can vary greatly depending on the wants and needs of a user, as well as the size and shape of the air conditioning unit 110 the flap component 120 is covering.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An air conditioning curtain device comprising:

at least one piece of material comprising a first end portion, a second end portion, and opposing sides; and at least one opening positioned in the at least one piece of material; and wherein the at least one piece of material is secured around a perimeter of an air conditioner output vent; and a flap component fixedly attached to an edge of the at least one opening for covering the at least one opening.

2. The air conditioning curtain device of claim 1, wherein elastic is secured around a perimeter of the at least one opening.

3. The air conditioning curtain device of claim 1, wherein the at least one piece of material is comprised of at least one of cotton, silk, rayon, denim, suede, leather, fur, matelasse, lace, velvet, polyesters, chenille, linen, satin, sheers, base cloth, vinyl, felt, nylon, tulle, or flax.

4. The air conditioning curtain device of claim 1, wherein the air conditioner is a window unit.

5. The air conditioning curtain device of claim 1, wherein the at least one opening is a generally circular through-hole.

6. The air conditioning curtain device of claim 1, wherein the at least one opening is a slit.

7. The air conditioning curtain device of claim 1, wherein the flap component is removably secured to the edge of the at least one opening.

8. The air conditioning curtain device of claim 7, wherein the flap component is removably secured to the edge of the at least one opening via hook and loop fasteners.

9. The air conditioning curtain device of claim 8, wherein the flap component is constructed of the same material as the at least one piece of material.

10. An air conditioning curtain device comprising:

at least one piece of material comprising a first end portion, a second end portion, and opposing sides; and at least one continuous opening positioned in the at least one piece of material; and wherein elastic is secured around a perimeter of the at least one continuous opening; and wherein the at least one piece of material is secured around a perimeter of an air conditioner output vent; and a flap component removably secured to an edge of the at least one continuous opening for covering the at least one continuous opening.

11. The air conditioning curtain device of claim 10, wherein the at least one continuous opening is generally circular and extends from one of said opposing sides to the other of said opposing sides.

12. The air conditioning curtain device of claim 10, wherein the at least one continuous opening is a slit.

13. The air conditioning curtain device of claim 10, wherein the flap component is removably secured to the edge of the at least one continuous opening via hook and loop fasteners.

14. The air conditioning curtain device of claim 13, wherein the flap component is constructed of the same material as the at least one piece of material.

15. An air conditioning curtain device comprising:

at least one piece of material comprising a first end portion, a second end portion, and opposing sides; and at least one continuous opening positioned in the at least one piece of material; and wherein elastic is secured around a perimeter of the at least one continuous opening; and wherein the at least one piece of material is secured around a perimeter of an air conditioner output vent; and a flap component fixedly attached to an edge of the at least one continuous opening for covering the at least one continuous opening.

16. The air conditioning curtain device of claim 15, wherein the flap component is removably secured to the edge of the at least one continuous opening via hook and loop fasteners.

17. The air conditioning curtain device of claim 16, wherein the flap component is constructed of the same material as the at least one piece of material.

* * * * *